US006469296B1

(12) United States Patent
Hansen et al.

(10) Patent No.: US 6,469,296 B1
(45) Date of Patent: Oct. 22, 2002

(54) ION ACCELERATION APPARATUS AND METHOD

(75) Inventors: Stuart C. Hansen; James Foote, both of Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/484,374

(22) Filed: Jan. 14, 2000

(51) Int. Cl.[7] ..... H01J 48/40
(52) U.S. Cl. ..... 250/287; 250/282
(58) Field of Search ..... 250/282, 286, 250/287, 296, 297, 299, 294

(56) References Cited

U.S. PATENT DOCUMENTS 3,553,452 A * 1/1971 Tiernan
5,614,711 A * 3/1997 Li et al. ..... 250/287
5,661,300 A * 8/1997 Hansen et al.
5,712,479 A * 1/1998 Reilly et al.
5,869,829 A * 2/1999 Dresch
6,013,913 A * 1/2000 Hanson
6,040,575 A * 3/2000 Whitehouse et al.
6,107,625 A * 8/2000 Park ..... 250/287

OTHER PUBLICATIONS

W. C. Wiley and I. H. McLaren, "Time–of–Flight Mass Spectrometer with Improved Resolution," The Review of Scientific Instruments, vol. 26, No. 12, Dec. 1955, pp. 1150–1157.

A. F. Dodonov, I. V. Chernushevich, and V. V. Laiko, "Electrospray Ionization on a Reflecting Time–of–Flight Mass Spectrometer," Chapter 7 in Time–of–Flight Mass Spectrometry, ed. Robert J. Cotter, ACS Symposium Series 549, 1994, pp. 108–123.

* cited by examiner

*Primary Examiner*—John R. Lee
*Assistant Examiner*—Anthony Quash

(57) ABSTRACT

An ion acceleration apparatus and method, and a mass spectrometer using the apparatus and method, require only a single pulse generator for the collection and acceleration of ions. The apparatus, method and mass spectrometer are useful in time-of-flight mass spectrometry (TOFMS). The apparatus, method and spectrometer save on manufacturing costs and complexity, without compromising measurement sensitivity or reliability. The ion acceleration apparatus comprises a plurality of conductive plates comprising a pulser electrode, three grids and preferably, a plurality of frames units, in a stacked relationship. The pulser electrode and a third grid form the outside ends of the ion acceleration apparatus. The plates of the stack are spaced apart and electrically insulated from one another. A power source provides fill, pulse and bias voltages to the plates. The power source comprises a pulse generator that provides fill and pulse voltages to the pulser electrode and to a first grid that is adjacent to the pulser electrode. A second grid is electrically connected to ground potential and is between the first grid and the plurality of guard frames. The power source further comprises a voltage source for supplying a fixed high voltage bias to the third grid and preferably to the frame units. During the fill period, analyte ions from an ion source are collected in a fill region between the pulser electrode and the first grid. The pulser electrode and first grid are supplied with a small magnitude voltage of a polarity opposite to a polarity of a charge of the analyte ions. During the pulse period, the analyte ions are induced to move from the fill region and into an acceleration region by the application of the pulse voltage to the pulse electrode and the first grid. The pulse voltage is a large magnitude voltage of the same polarity as the polarity of the charge on the analyte ions. A field produced by the fixed voltage bias applied to the third grid and guard frames accelerates the analyte ions once they enter the acceleration region.

9 Claims, 6 Drawing Sheets

ION ACCELERATION APPARATUS AND METHOD

TECHNICAL FIELD

This invention relates to ion accelerators. In particular, the invention relates to an ion acceleration apparatus and method for use in mass spectrometry, such as time of flight mass spectrometry.

BACKGROUND ART

Mass spectrometry is an analytical methodology used for quantitative elemental analysis of materials and mixtures of materials. In mass spectrometry, a sample of a material to be analyzed called an analyte is broken into particles of its constituent parts. The particles are typically molecular in size. Once produced, the analyte particles are separated by the spectrometer based on their respective masses. The separated particles are then detected and a "mass spectrum" of the material is produced. The mass spectrum is analogous to a fingerprint of the sample material being analyzed. The mass spectrum provides information about the masses and in some cases quantities of the various analyte particles that make up the sample. In particular, mass spectrometry can be used to determine the molecular weights of molecules and molecular fragments within an analyte. Additionally, mass spectrometry can identify components within the analyte based on the fragmentation pattern when the material is broken into particles. Mass spectrometry has proven to be a very powerful analytical tool in material science, chemistry and biology along with a number of other related fields.

A specific type of mass spectrometer is the time-of-flight (TOF) mass spectrometer. The TOF mass spectrometer (TOFMS) uses the differences in the time of flight or transit time through the spectrometer to separate and identify the analyte constituent parts. In the basic TOF mass spectrometer, particles of the analyte are produced and ionized by an ion source. The analyte ions are then introduced into an ion accelerator that subjects the ions to an electric field. The electric field accelerates the analyte ions and launches them into a drift tube or drift region. After being accelerated, the analyte ions are allowed to drift in the absence of the accelerating electric field until they strike an ion detector at the end of the drift region. The drift velocity of a given analyte ion is a function of both the mass and the charge of the ion. Therefore, if the analyte ions are produced having the same charge, ions of different masses will have different drift velocities upon exiting the accelerator and, in turn, will arrive at the detector at different points in time. The differential transit time or differential 'time-of-flight' separates the analyte ions by mass and enables the detection of the individual analyte particle types present in the sample.

When an analyte ion strikes the detector, the detector generates a signal. The time at which the signal is generated by the detector is used to determine the mass of the particle. In addition, for many detector types, the strength of the signal produced by the detector is proportional to the quantity of the ions striking it at a given point in time. Therefore, the quantity of particles of a given mass often can be determined also. With this information about particle mass and quantity, a mass spectrum can be computed and the composition of the analyte can be inferred.

In a time of flight mass spectrometer (TOFMS), the ion accelerator accepts a stream of ions from an ion source and accelerates the analyte ions by applying an electric field. The velocity of a given ion when it exits the ion accelerator is proportional to the square root of the accelerating field strength, the square root of the charge of the ion, and inversely proportional to the square root of the mass of the ion. Thus, ions with the same charge but differing masses are accelerated to differing velocities by the ion accelerator.

In addition to accelerating the analyte ions, the ion accelerator pulse modulates 25 the ion stream. The term "pulse modulation" as used herein refers to breaking the ion stream into a series of ion bunches or "packets", each packet being individually accelerated by action of the ion accelerator. The individual packets are accelerated and allowed to drift to the detector one packet at a time. To accomplish the pulse modulation, the ion accelerator collects ions produced by the ion source in an input or fill region for a period of time. The period or time interval during which ions are collected is known as the fill period or fill interval. The ion accelerator periodically releases the collected ions from the fill region into an acceleration region. The period when the ions are released from the fill region into the acceleration region is known as the pulse period or duration. The sequential fill and pulse periods produce packets of ions traveling in the drift region and striking the detector. The separation in time between the packets is designed to enable the measurement of the differential TOFs of the various analyte ions. Ion accelerators are sometimes also referred to as a "pulser" or an "ion storage modulator" due to the pulse modulation that they impart on the analyte ion stream.

A widely used, conventional ion accelerator used in mass spectrometry is based on a design first proposed by Wiley and Mclaren (W. C. Wiley and I. H. Mclaren, "Time-of-Flight Spectrometer with Improved Resolution," The Review of Scientific Instruments, vol. 26, no. 12, December, 1955, pp. 1150–1157) incorporated herein by reference. A description of a more contemporary version of the conventional accelerator based on the Wiley-Mclaren design is provided by Dodonov et al (A. F. Dodonov, et al, "Electrospray Ionization on a Reflecting Time-of-Flight Mass Spectrometer," in Time-of-Flight Mass Spectrometry, ed. Robert J. Cotter, ACS Symposium Series 549, American Chemical Society, Washington, D.C., 1994, Chapter 7, pp. 108–123) incorporated herein by reference. The mechanical configuration of the ion accelerator is illustrated in FIG. 1. A schematic of the conventional ion accelerator is illustrated in FIG. 2.

The ion accelerator comprises a stack or sequentially located plurality of thin metal plates or electrodes separated by insulating spaces or spacers. The conventional ion accelerator further comprises a pair of high voltage pulse generators, 22 and 23, a fixed high voltage bias source 24 and a multi-tap voltage divider 20.

The stack of electrodes comprises a first electrode 10, a first grid 12, a second grid 13, a third grid 14, and a plurality of guard frames 16. The first electrode 10 is a solid conductive plate called a pulser plate or pulser electrode. The grids 12, 13, and 14 are conductive plates each of which has a porous, conductive screen or wire mesh covering a hole or opening that penetrates from one side of the grid to the other. The guard frames 16 are also conductive plates with a hole similar to that of the grids 10–14 except the hole in the guard frames 16 is not covered with a screen.

In the ion accelerator, the electrodes are ordered such that the pulser electrode 10 is followed by the first and second grids 12, 13. The second grid 13, in turn, is followed by a plurality of guard frames 16 that, in turn, are followed by the third grid 14. A space between the pulser electrode 10 and the first grid 12 is called a fill region 17. The holes in the grids 12–14 and the guard frames 16 are aligned in the stack to produce a channel or path from the fill region 17 to the third grid 14. The channel is called the acceleration region 18.

As depicted in the schematic illustrated in FIG. 2, the conventional ion accelerator comprises the first high voltage pulse generator 22 connected to the pulser electrode 10 and the second high voltage pulse generator 23 connected to the second grid 13. The high voltage bias source 24 is connected to third grid 14. The high voltage bias source 24 is also connected to an input port of the multi-tap voltage divider 20. Each of the taps or output ports of the voltage divider 20 is connected, in turn, to one of the plurality of guard frames 16. Each of the guard frames 16 is, therefore, biased by the voltage divider such that the magnitude of voltage potential of a given guard frame 16 is less than that of the guard frames 16 closer to the third grid 14. The first grid 12 is connected to ground potential.

The voltage from the fixed high voltage bias source 24 applied to the third grid 14 and applied to the plurality of guard frames 16 through the voltage divider 20 produces an electric field in the acceleration region 18. The polarity of the voltage produced by the fixed high voltage bias source 24 is such that the resulting electric field in the accelerating region 18 produces a force that causes the ions to accelerate towards the third grid 14.

During operation, the conventional ion accelerator cycles or switches between two states or periods known as the "fill period" and the "pulse period", respectively. During the fill period, analyte ions having a charge are injected into the fill region 17 between the pulser plate 10 and the first grid 12. The analyte ions are produced by an ion source 26 and are induced to move into the fill region 17 under the influence of a voltage potential difference between the ion source 26 and the average voltage of the first grid 12 at ground potential and the pulser electrode 10 at approximately ground potential during the fill period. In addition, during the fill period a small voltage potential is applied to the second grid 13 by the second pulse generator 23. The small voltage potential has the same polarity as that of the charge on the analyte ions. The small potential applied to the second grid creates a potential gradient or barrier directed away from the acceleration region 18. This potential gradient prevents analyte ions from escaping or leaking from the fill region 17 into the acceleration region 18 during the fill period. An important feature of the conventional ion accelerator is its ability to prevent the leakage of analyte ions into the acceleration region 18 during the fill period by virtue of the presence of this potential gradient.

The pulse period commences once enough analyte ions have entered the fill region. During the pulse period, a large voltage pulse is applied to the pulser electrode 10 to "push" the ions out of the fill region 17 and into the acceleration region 18. The voltage pulse has the same polarity as the analyte ions thereby imparting a repulsive force to the ions in the fill region 17. At the same time, an opposite polarity voltage pulse is applied to the second grid 13 by the second pulse generator 23. The potential difference between the pulser plate 10 and the second grid 13 during the application of these pulses establishes an electric field oriented such that the analyte ions are induced to move out of the fill region 17 and into the acceleration region 18. Ideally the ions move as a tightly spaced group or packet.

Once in the acceleration region 18, the electric field created by the application of the voltage bias to the third grid 14 and by way of the voltage divider 20 to the guard frames 16, accelerates the analyte ions toward the third grid 14. As noted above, the high voltage bias source 24 supplies this voltage bias. The accelerated ions ultimately pass through the screen of the third grid 14 to enter the drift region of the TOFMS not shown in FIGS. 1 and 2.

The relationship between the voltage potentials applied to the pulser electrode 10, the grids 12–14 and the guard frames 16 for the conventional ion accelerator is illustrated in FIG. 3 and FIG. 4. In FIG. 3 the relative voltage levels in a conventional ion accelerator having n guard frames 16 is illustrated. In FIG. 3 the voltage level is represented by the y-axis and the relative locations of the plates in the stack are illustrated on the x-axis. The voltages applied to the pulser electrode 10 are labeled P. The voltages applied to the first grid 12, the second grid 13, and the third grid 14 are labeled $G_1$, $G_2$ and $G_3$ respectively. The voltages used to bias the n guard frames are labeled $F_1$–$F_n$. The voltages for both the fill period and the pulse period are shown. The voltage levels shown are relative since the specific levels are a function of the specific TOFMS design and given analysis situation and would be readily determined by one skilled in the art.

FIG. 4 illustrates the relative voltages applied to the pulser electrode 10, first grid 12 and second grid 13, as a function of time. The voltages associated with the pulser electrode 10 are illustrated in the sub-plot labeled "Pulser". The voltages associated with the first grid 12 are illustrated in the sub-plot labeled "Grid 1" and voltages associated with the second grid 13 are illustrated in the sub-plot labeled "Grid 2". In FIG. 4, voltage is shown on the y-axis with time on the x-axis. In each of the subplots of FIG. 4, the fill period is represented as the time interval $t_f$ and the pulse period is represented by the time interval $t_p$. Notice that the first grid 12 (Grid 1) is essentially at zero volts during both the fill period and the pulse period.

The sensitivity and precision of the TOFMS depend on the ability of the ion accelerator to produce sharply defined pulses or packets of ions. To produce sharply defined pulses, the ion accelerator must minimize the number of ions that move or leak from the fill region 17 to the acceleration region 18 during the fill period. Additionally, the ion accelerator must be able to move ions from the fill region 17 to the acceleration region 18 in a short period of time during the pulse period. The conventional ion accelerator utilizes two synchronized high voltage pulse generators, 22 and 23, to accomplish the pulse modulation of the ion stream. These pulse generators are expensive to manufacture due to the typical voltage levels involved and the rise and fall times required to produce the desired ion pulses. In addition, circuitry must be provided to synchronize the pulse generators so that the voltage pulses occur simultaneously and to produce well defined ion pulses. Finally, in the conventional ion accelerator, the second pulse generator 23 must also be capable of producing the necessary opposite polarity bias voltage that is applied to the second grid 13 during the fill period thereby preventing the analyte ions from leaking in the acceleration region 18 prior the onset of the pulse period.

Thus, it would be advantageous to have an ion accelerator for use in a TOFMS that had only one pulse generator but exhibited minimal leakage during the fill period and that still produced sharply defined pulses during the pulse period. Such an ion accelerator would be lower in cost and higher in reliability than conventional ion accelerators while still maintaining the measurement sensitivity required for modern TOFMS.

SUMMARY OF THE INVENTION

The present invention provides an ion acceleration apparatus and method, which can be used in mass spectrometry, that utilize a single pulse generator while incorporating the advantages and performance characteristics of the state-of-the-art conventional ion accelerators.

In one aspect of the invention, an ion acceleration apparatus is provided that comprises a plurality of conductive plates in a spaced apart, stacked relationship. The plurality of plates comprises a pulser electrode and a plurality of grids. The pulser electrode and a third grid of the plurality grids form the outside ends of the stack with a first grid and a second grid interposed therebetween. The first grid is adjacent to the pulser electrode and a space between the pulser electrode and the first grid forms a fill region of the ion acceleration apparatus. A space between the second grid and the third grid forms an acceleration region that is adjacent to the fill region.

According to this aspect of the invention, analyte ions, having a charge polarity, are collected in the fill region during a fill period and the collected analyte ions are accelerated in the acceleration region toward the third grid at an output end of the stack during a pulse period. During the fill period, the electrode and the first grid each has a fill voltage with a polarity opposite to the charge polarity of the analyte ions, and during the pulse period the electrode and the first grid each has a pulse voltage with a polarity that is the same as the charge polarity of the analyte ions. The second grid has zero voltage and the third grid has a voltage with a polarity that is opposite the charge polarity of the analyte ions during both the fill period and the pulse period.

Preferably, the plurality of plates further comprises a plurality of guard frames, also known as frame units, interposed between the second grid and the third grid. The second grid is adjacent to a first guard frame of the plurality of guard frames and the third grid is adjacent to a last guard frame of the plurality of guard frames. Moreover, each of the pulser electrode, grids and guard frames are electrically insulated and spaced apart from one another preferably by insulating spacers. In addition, each grid and guard frame has a through hole, such that when stacked together an aligned channel or acceleration path is formed through the stack between the second grid and the third grids. Preferably, the holes in the grids are covered by a porous mesh or screen.

The ion acceleration apparatus further comprises a power source for generating voltages during the fill period and the pulse period. The power source preferably comprises a pulse generator for supplying the fill voltage and the pulse voltage to the electrode and to the first grid and a voltage source for supplying voltage to the third grid, and preferably to the plurality of guard frames. More preferably, the power source further comprises a first voltage divider connected between the pulse generator and the first grid for providing lower magnitude replicas of the fill voltage and the pulse voltage to the first grid than is supplied to the pulser electrode. In addition, the power source still further comprises a second voltage divider connected between the voltage source and the plurality of guard frames, such that the voltage applied to each guard frame by the voltage source increases in magnitude from the first guard frame to the last guard frame.

In another aspect of the invention, a method of pulse modulating and accelerating analyte ions using the ion acceleration apparatus described above is provided. During the fill period, the power source applies a fill voltage to the pulser electrode and the first grid. The analyte ions from an ion source enter the fill region where the analyte ions remain until a pulse voltage applied to the pulser electrode and first grid launches them into the acceleration region toward the third grid. The fill voltage is a small magnitude voltage potential of polarity opposite to that of the polarity of the charge on the analyte ions. The second grid is maintained at zero potential and the third grid has a constant voltage applied thereto of a polarity opposite to the polarity of the charge on the analyte ions. Preferably, each frame of the plurality of guard frames also has a progressively increasing magnitude voltage constantly applied thereto. The polarity of the voltage applied to the guard frames is opposite to that of the polarity of the charge on the analyte ions. The magnitude of the constant voltage applied to the third grid is greater in magnitude than the magnitude of voltage applied to the last guard frame of the plurality of guard frames located nearest to the third grid.

During the pulse period, the power source applies a voltage pulse to the pulser electrode and the first grid of the same polarity as the polarity of the charge of the analyte ions. The analyte ions that have collected in the fill region are launched or caused to move into the acceleration region. The voltages on the second grid, the plurality of guard frames and the third grid are constant and do not change during or between the pulse period and the fill period.

In still another aspect of the invention, a mass spectrometer (MS) is provided that utilizes the ion acceleration apparatus and method described above instead of conventional ion accelerators and methods. The MS of the invention comprises the conventional components of a MS, such as an ion source, an ion drift region and an ion detector. Moreover, the MS of the invention further comprises the ion acceleration apparatus of the present invention. When used in time-of-flight mass spectrometry, the time-of-flight mass spectrometer (TOFMS) of the invention provides comparable sensitivity to the measurement capability of state-of-the-art TOFMS at a lower cost and reduced complexity by virtue of the absence of a second pulse generator and associated synchronization circuitry.

In the present invention, a small same-polarity pulse (relative to pulser electrode) is applied to the first grid instead applying a complementary-opposite polarity pulse to the second grid, as is conventionally done. Advantageously, a simple voltage divider connected to the pulse generator is used to obtain the small same polarity pulse and therefore, a separate opposite polarity pulse generator is not needed.

Another feature of the ion acceleration apparatus of the present invention is that the second grid is used essentially as a first "electrode" in "a string of electrodes" or the plurality of guard frames. As mentioned above, each guard frame of the plurality of guard frame is connected to sequential taps of a voltage divider and the second grid is connected to ground potential. This greatly simplifies the circuitry needed to generate the voltages needed to bias the guard frames and the second grid. In fact, the bias voltages required can be generated using a simple, linear voltage divider, for example. One skilled in the art would readily recognize alternative methods for generating these bias voltages that are equivalent to using a voltage divider.

Moreover, when a small bias of opposite polarity to the polarity of the analyte ions is applied on the pulser electrode and similarly on the first grid during the "fill" period, advantageously, the invention provides a gating action that is created to prevent incoming ions from spilling or leaking into the acceleration region prior to the launch of an ion packet. By preventing ions from leaking into the acceleration region, the gating action provides a significant reduction in baseline noise. Decreasing baseline noise, in turn, increases the signal to noise ratio and thereby increases the sensitivity of the TOFMS.

BRIEF DESCRIPTION OF THE DRAWINGS

The various features and advantages of the present invention may be more readily understood with reference to the following detailed description and examples taken in conjunction with the accompanying drawings, where like reference numerals designate like structural elements, and in which.

MODES FOR CARRYING OUT THE INVENTION

Figure 5:
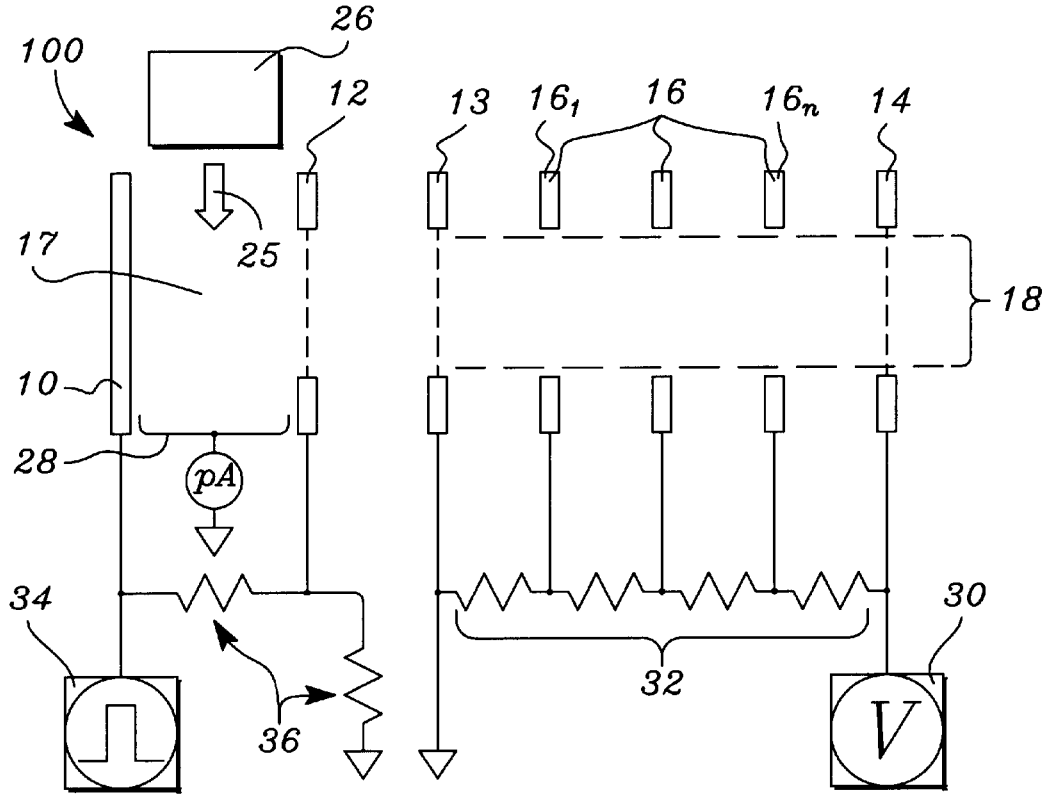
FIG. 5 illustrates a schematic diagram of the ion acceleration apparatus of the present invention.

The ion acceleration apparatus 100 of the present invention is illustrated schematically in FIG. 5. As in the conventional ion accelerator, the ion acceleration apparatus 100 of the present invention comprises a plurality of conductive plates. The plurality of conductive plates comprises a pulser plate or pulser electrode 10, a plurality of grids 12, 13, 14 and preferably, a plurality of guard frames 16, spaced apart and insulated from each other in a stacked relationship. The spacing between the pulser electrode 10, the plurality of grids 12, 13, and 14 and the plurality of guard frames 16 is achieved and maintained in practice using insulating spacers of a suitable insulating material such as ceramic, for example. The pulser electrode 10 and a third grid 14 of the plurality of grids form the outside ends of the stack with a first grid 12 and a second grid 13 of the plurality of grids and the plurality of guard frames 16 interposed therebetween. The first grid 12 and the second grid 13 are spaced apart from and stacked side by side between the pulser electrode 10 on one side and a first frame $\mathbf{16}_1$ of the plurality of guard frames 16 on an opposite side. The first grid 12 is adjacent to the pulser electrode 10. A space between the pulser electrode 10 and the first grid 12 forms a fill region 17 of the ion acceleration apparatus 100. The second grid 13 is spaced from and adjacent to the first guard frame $\mathbf{16}_1$. The third grid 14 is spaced from and adjacent to a last frame $\mathbf{16}_n$ of the plurality of guard frames 16, wherein the number of guard frames n in the plurality of guard frames typically ranges from one to ten. Preferably, the number of guard frames n is in the range of six to ten. The number n of guard frames is set by practical considerations and typically consists of a trade-off between of the degree of field penetration into the center of the stack from outside regions and the cost of a larger number n of guard frames. One skilled in the art would readily be able to determine a suitable number n for a given application without undue experimentation.

The pulser electrode 10, grids 12, 13, 14 and the plurality of guard frames 16 are constructed from thin metal plates and, for example, stainless steel, nickel, or tantalum can be used. Preferably, the metal plates are made from non-magnetic stainless steel. The metal material used should be non-corrosive and non-reactive and should not have, or form, non-conductive oxides on the surfaces of the metal. Non-magnetic metals are preferred because they reduce or eliminate the detrimental effects that a magnetic field associated with the metal might have on the flight path characteristics of the analyte ions moving through the ion acceleration apparatus 100.

The thickness of the thin metal plates used in the ion accelerator 100 ranges from about 0.005 inches to 0.030 inches. Preferably, the thin metal plates range in thickness from about 0.015 inches to 0.025 inches. All of the metal plates used in the acceleration apparatus 100 are nominally of the same thickness.

The dimensions of the overall stack of metal plates are generally determined analytically from the operating parameters of a given application of the ion acceleration apparatus 100. One skilled in the art would readily be able to determine the dimensions using the standard practices of TOFMS. However, with the exception of the fill region 17 space, typically the spacing between the metal plates is between about 0.080 inches and 0.500 inches. Preferably the spacing is between about 0.200 inches to 0.250 inches. The fill region 17 space between the pulser electrode 10 and the first grid 12 is preferably about one fifth of the distance from the first grid 12 and the third grid 14.

As mentioned above, the plurality of metal plates are separated by electrical insulators or insulating spacers. The spacers are located around the periphery of the metal plates. The spacers are typically constructed from materials such as ceramic or a vacuum compatible plastic. Preferably, the electrical insulator that separates the metal plates is ceramic. Ceramic, in particular alumina, is known by those skilled in the art as a good electrical insulator that is chemically inert and compatible with a high vacuum environment.

Each grid 12, 13, 14 and guard frame has a central hole, such that when stacked together, an aligned channel or acceleration region 18 is formed through the stack between the second grid 13 and the third grid 14. The plurality of grids 12, 13,14 have thin, highly porous metal mesh material attached over their central holes. The mesh material can be made from metal materials such as nickel, stainless steel, gold or tantalum. In the preferred embodiment, the metal mesh material is nickel or gold. The highly porous mesh is intended to minimize electric field penetration and the probability of analyte ion capture Analyte ion capture occurs when an ion impacts the material of the metal mesh. Ion capture can occur when the ions are moving from the fill region 17 and into the acceleration region 18 and/or when analyte ions are accelerating in the acceleration region 18. Preferably the open space in the mesh is about 90% or greater. In addition, preferably the mesh comprises about 70 wires per inch wherein each wire has a diameter of about 0.00073 inches.

The pulser electrode 10, also referred to as the "pusher" electrode 10, is a solid metal plate (having no central hole).

Each guard frame $16_i$ (i=1→n) in the plurality of guard frames 16 does not have a metal mesh covering its central hole.

The ion acceleration apparatus 100 further comprises a pulse generator 34, preferably a high voltage pulse generator 34 and preferably, a first voltage divider 36. The high voltage pulse generator 34 is electrically connected to the pulse electrode 10 to provide a fill voltage and a pulse voltage described hereinbelow. The first voltage divider 36 is electrically connected between the pulse generator 34 and ground. The first voltage divider 36 comprises a first and a second resistor connected in series. The second resistor is electrically connected to ground. The junction between the first and second resistors is an output of the first voltage divider 36 that is electrically connected to the first grid 12 to provide a fill voltage and a pulse voltage to the first grid 12 that is a fraction of the fill and pulse voltages applied to the pulser electrode 10.

The ion acceleration apparatus 100 still further comprises a voltage source 30, preferably a fixed high voltage bias source 30 and preferably, a second voltage divider 32. The fixed high voltage bias source 30 produces a fixed voltage level or bias $V_{drift}$ and is electrically connected to the third grid 14 and to an input of the second voltage divider 32. The second voltage divider 32 is comprised of n+1 resistors connected in series where n is the number of guard frames 16. The (n+1)th resistor is, in turn, electrically connected to ground. The junctions between resistors act as n outputs of the voltage divider 32. The n outputs of the second voltage divider 32 are connected to the n guard frames 16. Therefore, each of the guard frames 16 is biased by the second voltage divider 32 such that the magnitude of the bias voltage of a given guard frame 16 is less than that of the guard frames 16 closer to the third grid 14 and greater than that of a guard frame $16_i$ farther from the third grid 14. Preferably, the resistors of the second voltage divider are chosen such that a linearly decreasing voltage is applied to successive guard frames 16 wherein the voltage level at a given guard frame $16_i$(i=1→n) is proportional to its relative distance from the third grid 14. The second grid 13 is electrically connected to ground potential. The effect of the voltage biases applied to third grid 14 and the plurality of guard frames 16 increases incrementally from the first guard frame $16_i$, closest to the second grid 13, to the last guard frame $16_{n2}$ closest to the third grid 14. The polarity of the fixed voltage bias source 30 is chosen such that the analyte ions are accelerated toward the third grid 14 by the electric field in the acceleration region 18.

While in operation, the ion acceleration apparatus 100 of the present invention cycles or switches between two states or periods known as the "fill period" and the "pulse period", respectively. During the fill period, analyte ions having a charge are injected into the fill region 17 between the pulser plate 10 and the first grid 12. The analyte ions are produced by an ion source 26 and are induced to move into the fill region under the influence of a voltage potential difference between the ion source 26 and the average voltage of the first grid 12 and the pulser electrode 10. An ion collector 28 is located at an opposite end of the fill region from the ion source 26. Moreover, during the fill period a small voltage potential called the fill voltage is applied by the high voltage pulse generator 34 to the pulser electrode 10 and, by way of the first voltage divider 36, an incrementally smaller voltage potential is applied to the first grid 12. The fill voltages each have polarity opposite to that of the charge of the analyte ions. The small voltage potentials applied to the pulser electrode 10 and the first grid 12 create an electric field that preferentially keeps the ions away from the second grid 13 which is at ground potential. By preventing the ions from moving towards the second grid 13, the fill voltages help to keep the analyte ions in the fill region 17 during the fill period. Viewed another way, the electric field created by the application of the fill voltages has the effect of creating a potential gradient or barrier away from the acceleration region 18. This potential gradient prevents analyte ions from escaping or leaking from the fill region 17 into the acceleration region 18 during the fill period.

The pulse period commences once enough analyte ions have entered the fill region 17. The quantity of ions in the fill region 17 can be inferred from information known about the ion source 26 and the current measured by a picoammeter (pA) connected between the ion collector 28 and ground. During the pulse period, a large voltage pulse from the high voltage pulse generator 34 is applied to the pulser electrode 10 to "push" the analyte ions out of the fill region 17 and into the acceleration region 18. Simultaneously, the large voltage pulse is converted into a slightly lower magnitude voltage pulse that is applied to the first grid 12 by the action of the first voltage divider 36. The voltage pulses applied to the pulser electrode 10 and the first grid 12 have the same polarity as the charge of the analyte ions. The difference in voltage potential between the pulser electrode 10 and the first grid 12 produces a force on the analyte ions in the fill region 17 that induces the ions to move out of the fill region 17 in the direction of the acceleration region 18. Once the analyte ions pass through the first grid 12, they are subjected to an electric field produced by the difference in the voltage potentials of the first grid 12 and the second grid 13 (at zero potential) that additionally moves the ions toward the acceleration region 18.

Once in the acceleration region 18, the electric field created by the application of the incrementally increasing voltage bias from the second grid 13 to the third grid 14 by fixed high voltage bias source 30 and the second voltage divider 32 accelerates the analyte ions toward the third grid 14. The accelerated ions ultimately pass through the screen of the third grid 14 to enter a drift region of the TOFMS (illustrated in FIG. 9).

Figure 6:
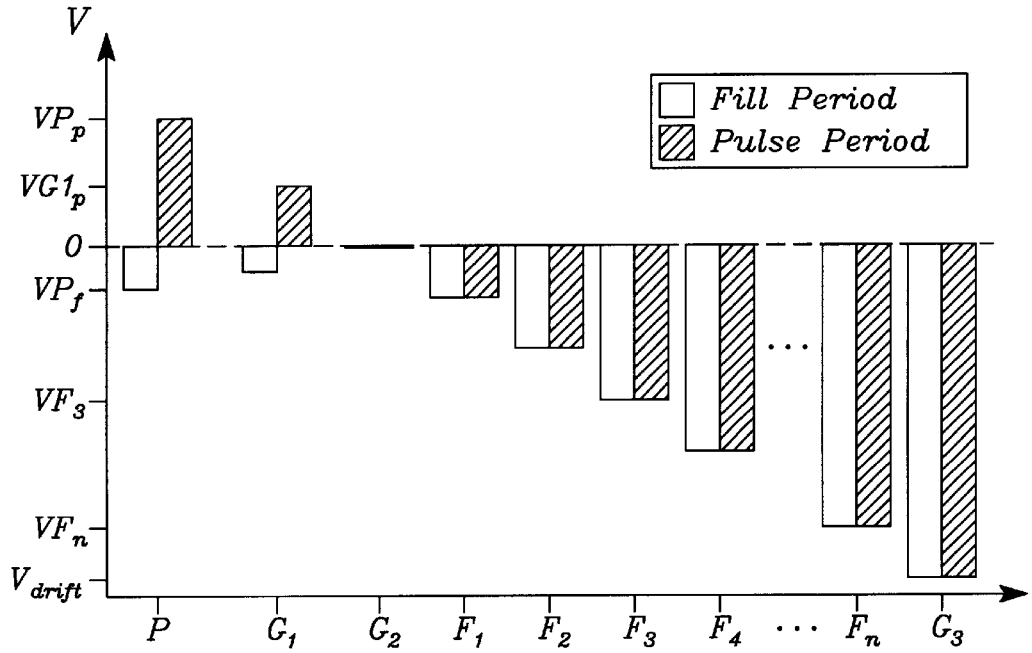
FIG. 6 illustrates a bar graph of the voltages applied to the ion acceleration apparatus during the fill period and the pulse period in accordance with the invention.
Figure 7:
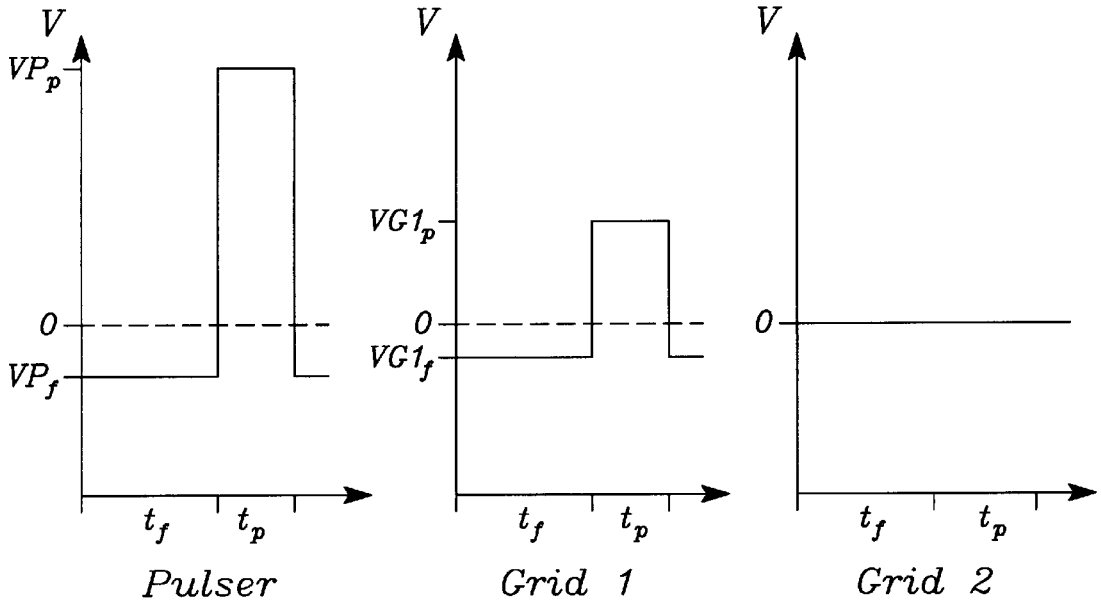
FIG. 7 illustrates a plot of the voltage as a function of time that is applied to the ion acceleration apparatus during both the fill period and pulse period in accordance with the present invention.

The relationship between the voltage potentials applied to the plurality of conductive plates (the pulser electrode 10, the grids 12–14 and the guard frames 16) for the ion acceleration apparatus 100 according to the present invention is illustrated in FIG. 6 and FIG. 7. In FIG. 6 the relative voltage levels in the ion acceleration apparatus 100 of the present invention, having n guard frames 16, is illustrated. In FIG. 6 the voltage level is represented by the y-axis and the relative locations of the plates in the stack are illustrated on the x-axis. The voltages applied to the pulser plate 10 are labeled P and are illustrated having a magnitude of $VP_f$ during the fill period and $VP_p$ during the pulse period. The voltages applied to the first grid 12, the second grid 13, and the third grid 14 are labeled $G_1$, $G_2$ and $G_3$ respectively. The magnitudes of the voltages applied to the first grid 12 are $VG1_f$ and $VG1_p$ during the fill and pulse periods respectively. The magnitude of the voltage used to bias the third grid 14 is $V_{drift}$ for both the fill and pulse periods. Similarly, the voltages used to bias the n guard frames 16 are labeled $F_1$–$F_n$ and have magnitudes of $VF_1$–$VF_n$ respectively. The second grid 13 is at zero potential for both the fill and pulse periods.

FIG. 7 illustrates the relative voltages applied as a function of time to the pulser electrode 10 (sub-plot labeled "Pulser") the first grid 12 (sub-plot labeled "Grid 1") and the second grid 13 (sub-plot labeled "Grid 2"). Voltage is shown on the y-axis with time on the x-axis of these subplots. In each of the subplots of FIG. 7, the fill period is represented by the time interval $t_f$ and the pulse period is represented by the time interval $t_p$. The length of the time intervals $t_f$ and $t_p$ are a function of the analyte ions for a given analysis. One skilled in the art would readily be able to determine the time intervals $t_f$ and $t_p$ for a given analysis without undue experimentation.

Figure 1:
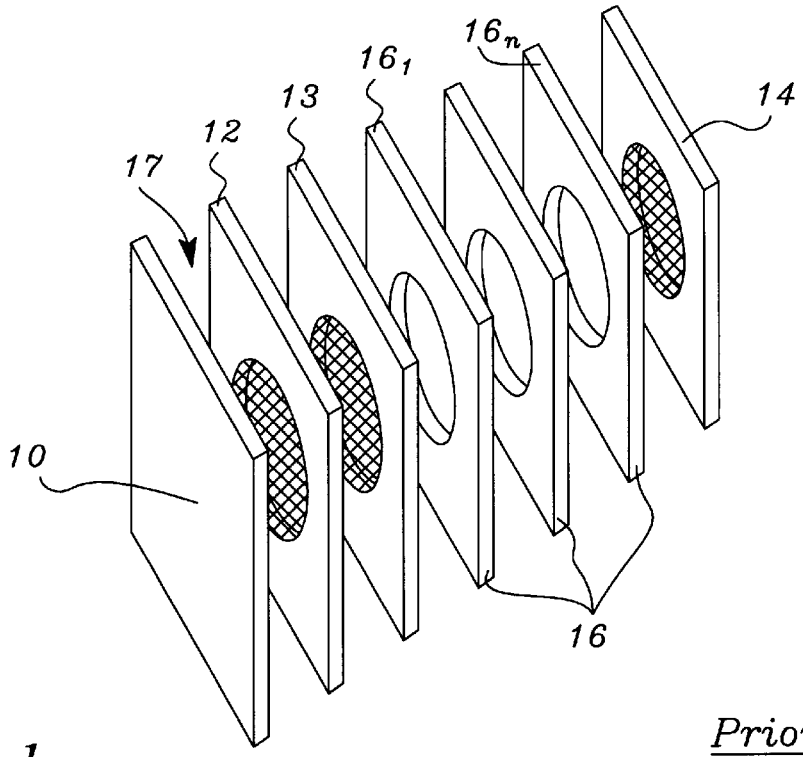
Prior Art FIG. 1
FIG. 1 illustrates a perspective drawing of an ion acceleration apparatus.
Figure 2:
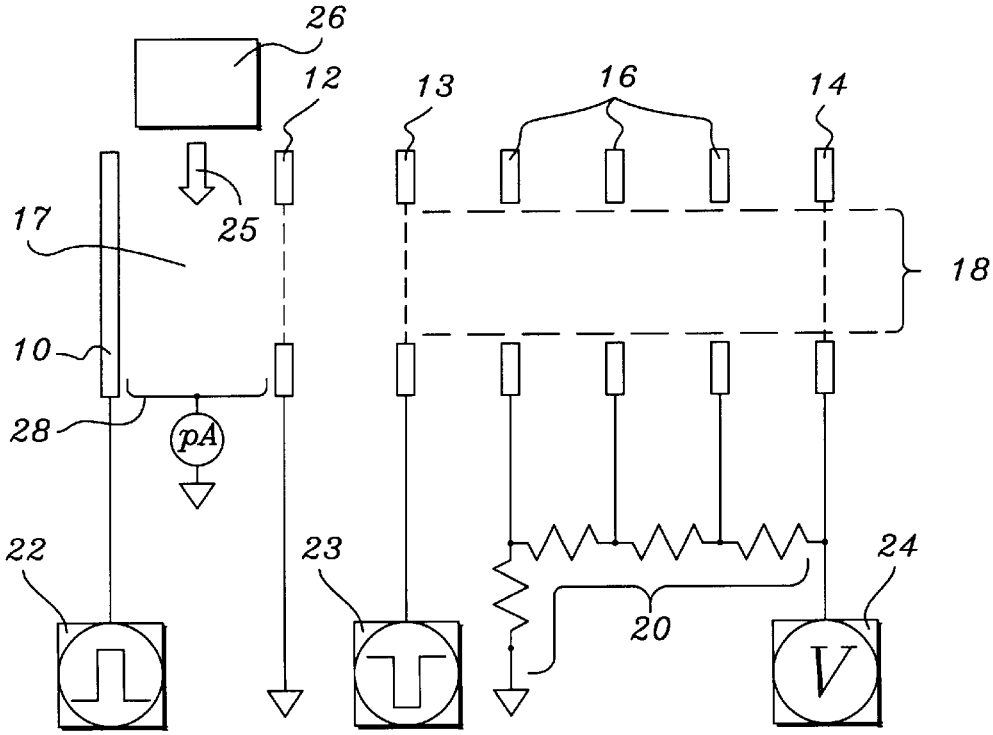
Prior Art FIG. 2
FIG. 2 illustrates a schematic diagram of a conventional ion accelerator of the prior art.
Figure 3:
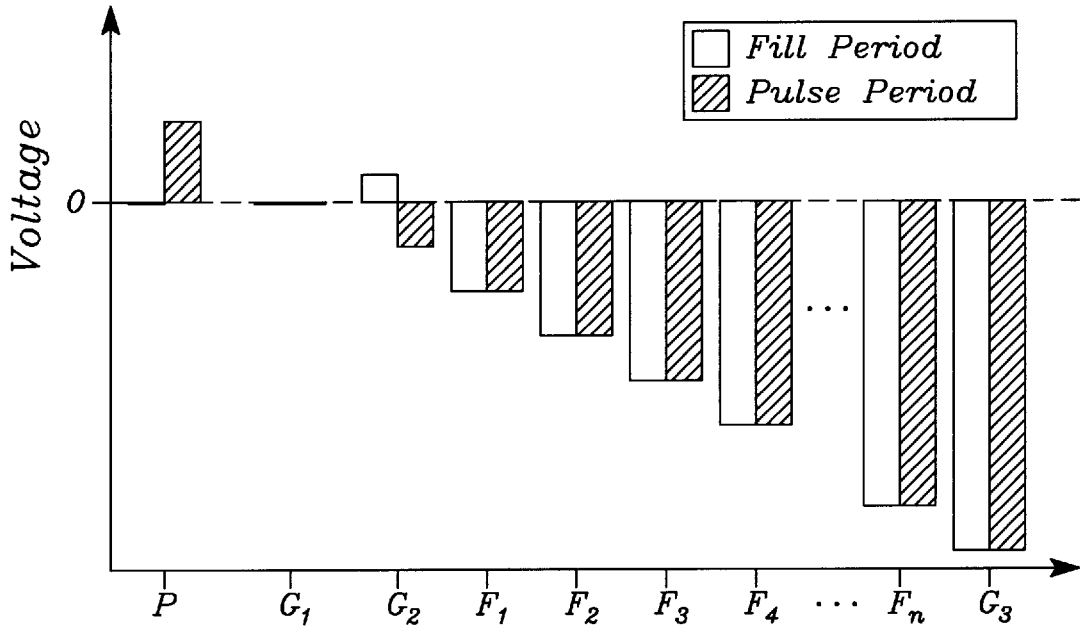
Prior Art FIG. 3
FIG. 3 illustrates a bar graph of the voltages applied to the ion accelerator during the fill period and the pulse period in accordance with the prior art.
Figure 4:
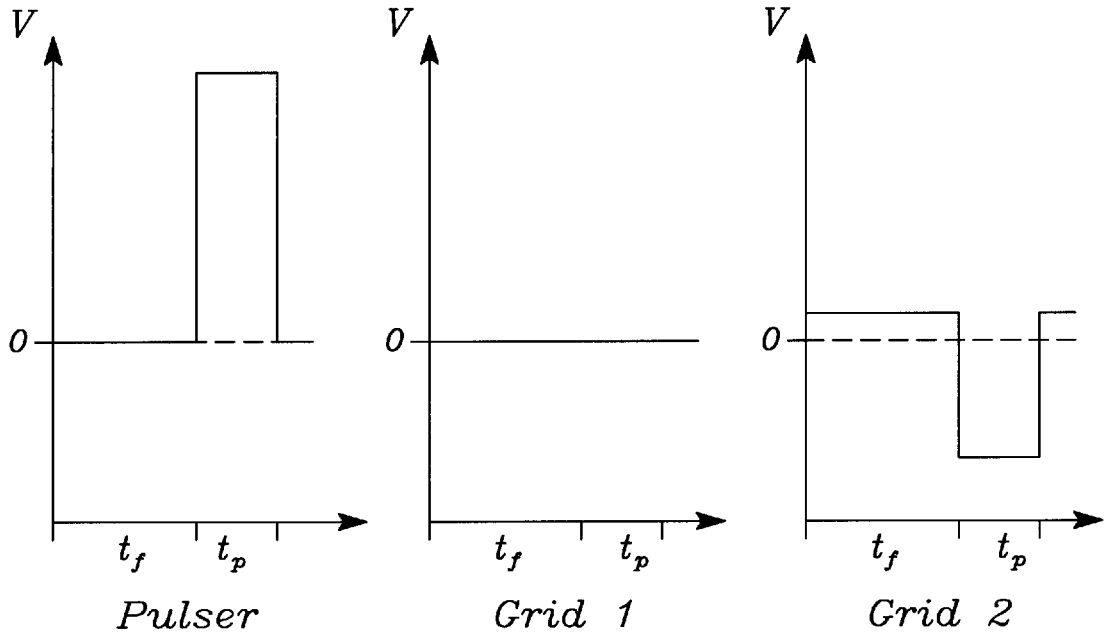
Prior Art FIG. 4
FIG. 4 illustrates a plot of the voltage as a function of time that is applied to the pulser, grid 1 and grid 2 during both the fill period and pulse period in accordance with the ion accelerator of the prior art.

FIGS. 6 and 7 illustrate some of the differences between the applied voltages of the present invention relative to FIGS. 2 and 3 of the prior art. For example, notice that it is the second grid 13 (Grid 2) that is essentially 0 volts during both the fill period and the pulse period in contrast to the first grid 12 (Grid 1) of the conventional ion accelerator being at zero potential as shown in FIG. 4.

The specific voltage levels applied to the grids and guard frames are a function of the design of the ion accelerator and the specific analyte ion type or types as well as the TOFMS design. The appropriate voltage levels are readily determined by one skilled in the art. For example, the fill period voltage produced by the high voltage pulse generator 34 and applied to the pulser electrode 10 during the fill period has a magnitude $VP_f$ that can be between about 1V and 10V, and preferably, is between about 1V and 3V. As noted above, the polarity of the applied fill period voltage $VP_f$ is opposite to that of the polarity of the charge of the analyte ions. The fill period voltage applied to the first grid 12 has a magnitude $VG1_f$ that is incrementally less than the voltage $VP_f$ applied to the pulser electrode 10 and is dictated by the design of the first voltage divider 36. Preferably, the first voltage divider 36 is designed such that the magnitude of the voltage $VG1_f$ applied to the first grid 12 is proportional to the distance between the first grid 12 and the second grid 13 relative to the distance between pulser electrode 10 and the second grid 13. The effect of this approach to the design is to produce a linearly decreasing voltage potential when moving from the pulser electrode 10 to the second grid 13 during the pulse period. The pulse period voltage produced by the high voltage pulse generator 34 and applied to the pulser electrode 10 during the pulse period has a magnitude $VP_p$ that can be between about 100V and 2 kV, and preferably, is between about 150V and 400V. The polarity of the pulse period voltage, as noted hereinabove, is the same as that of the charge of the analyte ions. The pulse period voltage applied to the first grid 12 has a magnitude $VG1_p$ that is determined by the design of the first voltage divider 36 as described above.

The high voltage bias source 30 produces a voltage $VP_{drift}$ with a magnitude of between about 100V and 10 kV and preferably, between 400V and 6 kV. Typically the second voltage divider 32 is designed such that the voltage on successive guard frames 16 decreases linearly with distance from the third grid 14.

Figure 8:
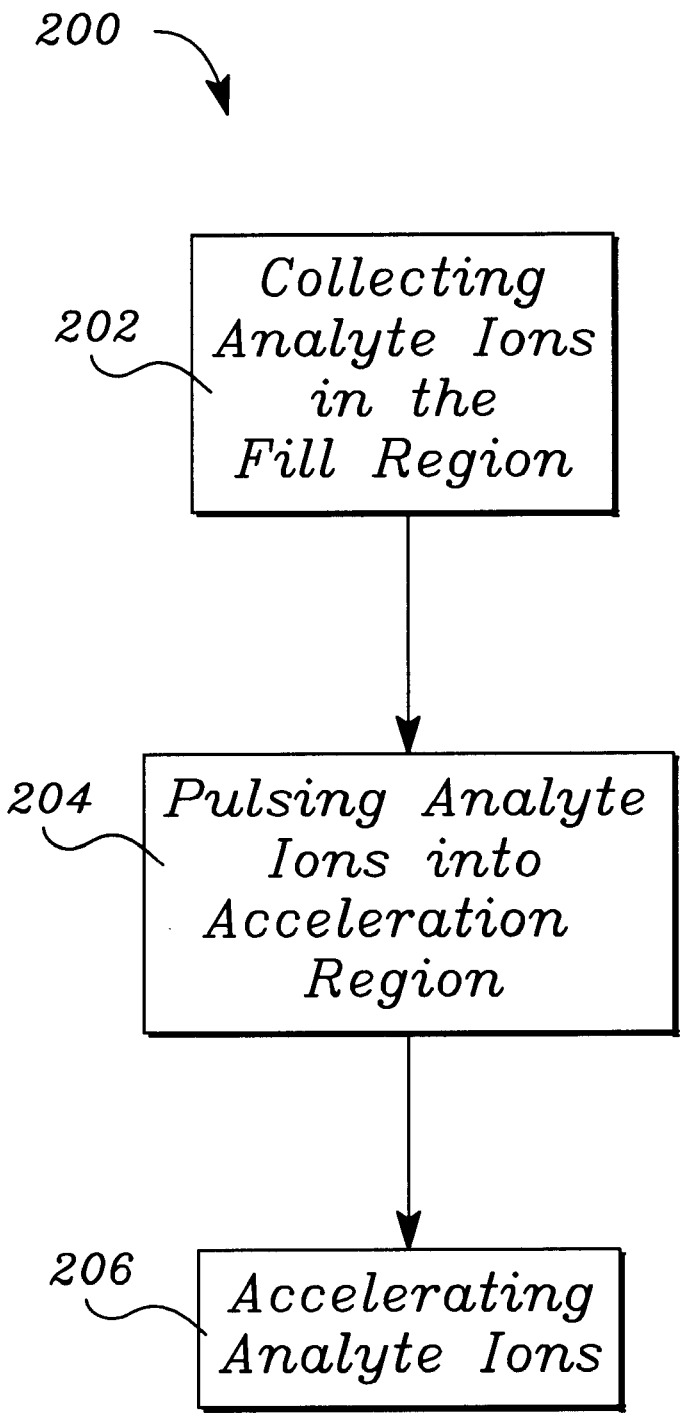
FIG. 8 illustrates a block diagram of the method for pulse modulating and accelerating analyte ions using the ion acceleration apparatus of the present invention.

In accordance with the invention, a method 200 is provided for pulse modulating and accelerating analyte ions using the ion acceleration apparatus 100 described hereinabove. A block diagram of the method 200 is illustrated in FIG. 8. The method 200 of the present invention comprises the step of applying fill period voltages $VP_f$ and $VG1_f$ to the electrode plate 10 and the first grid 12, respectively, during a fill period. The fill period voltage $VP_f$ is a small magnitude voltage with a polarity opposite to that of the polarity of the charge of the analyte ions. The fill period voltage $VG1_f$ is a small magnitude voltage of magnitude less than or equal to the voltage $VP_f$ and a polarity that is the same as that of voltage $VP_f$.

During the fill period, analyte ions produced by the ion source 26 are injected into and collected 202 in the fill region 17. Analyte ions are prevented from moving from the fill region 17 into the acceleration region 18 of the ion acceleration apparatus 100 by the presence of an electric potential gradient directed away from grid 12 produced by the application of the fill period voltages, $VP_f$ and $VG1_f$, during the fill period. Analyte ions are injected into the fill region 17 until a sufficient number of analyte ions have been collected 202 in the fill region 17. Determination of how many analyte ions should be injected into and collected 202 in the fill region 17 during the fill period is a function of the type of analyte ions being analyzed and would be readily determined for a specific analysis by one skilled in the art.

The method 200 of the present invention still further comprises the step of applying pulse period voltages, $VP_p$ and $VG1_p$, to the electrode plate 10 and the first grid 12, respectively, during the pulse period. The pulse period voltage $VP_p$ on the pulser electrode 10 is a large magnitude voltage (relative to the fill period voltages $VP_f$, $VG1_f$) with a polarity that is the same as that of the charge of the analyte ions. The pulse period voltage $VG1_p$ on the first grid 12 is a large magnitude voltage that is less than or equal to $VP_p$ and has a polarity that is the same as that of $VP_p$. The pulse period voltages are applied for a period of time sufficient to move the analyte ions from the fill region 17 to the acceleration region 18. The length of the pulse period $t_p$ is a function of the type of analyte ions being analyzed and would be readily determined for a specific analysis by one skilled in the art.

During the pulse period, the collected analyte ions are pushed or pulsed 204 out of the fill region 17 and into the acceleration region 18 of the apparatus 100.

The method 200 of the present invention still further comprises the step of applying bias voltages to the third grid 14 and preferably, to the guard frames 16, and applying a zero voltage potential to the second grid 13 to create an electric field in the acceleration region 18 during both the fill period and the pulse period. The bias voltage applied to the third grid 14 is has a magnitude $V_{drift}$ and has a polarity that is opposite that of the charge of the analyte ions. The bias voltages applied to the guard frames 16 have magnitudes $VF_1$ to $VF_n$ such that $|V_{drift}|>|VF_n|>|VF_{n-1}|> \ldots >|VF_1|>0$ and the polarity is the same as the polarity of the voltage applied to the third grid 14. The ith bias voltage $VF_i$ is applied to the ith guard frame $\mathbf{16}_i$(i=1→n) where the guard frames are numbered sequentially from a 1st guard frame $\mathbf{16}_1$ adjacent to the second grid 13 to an nth guard frame $\mathbf{16}_n$ adjacent to the third grid 14. The collected analyte ions are accelerated 206 in the acceleration region 18 and ejected out of the ion acceleration apparatus 100 through the third grid 14. The ions are accelerated by the electric field created in the acceleration region 18 by the bias voltages $V_{drift}$, $VF_1$ to $VF_n$, applied to the guard frames 16 and the third grid 14.

A prototype ion acceleration apparatus 100 of the present invention was constructed. The plurality of plates including the pulser electrode 10, the plurality of grids 12, 13, 14, and the plurality of guard frames 16 were all fabricated from stainless steel. Each plate in the plurality of plates was approximately 1.5 inches by 1.5 inches with a nominal thickness of 0.02 inches. The mesh material of the plurality of grids 12, 13, 14, was made of nickel. Alumina spacers with a thickness of about 0.15 inches were used to maintain the spacing between the plates. The central holes in the grids 12, 13, 14 and the plurality of guard frames 16 that form the acceleration region 18 were circular with a diameter of 0.75 inches.

Figure 9:
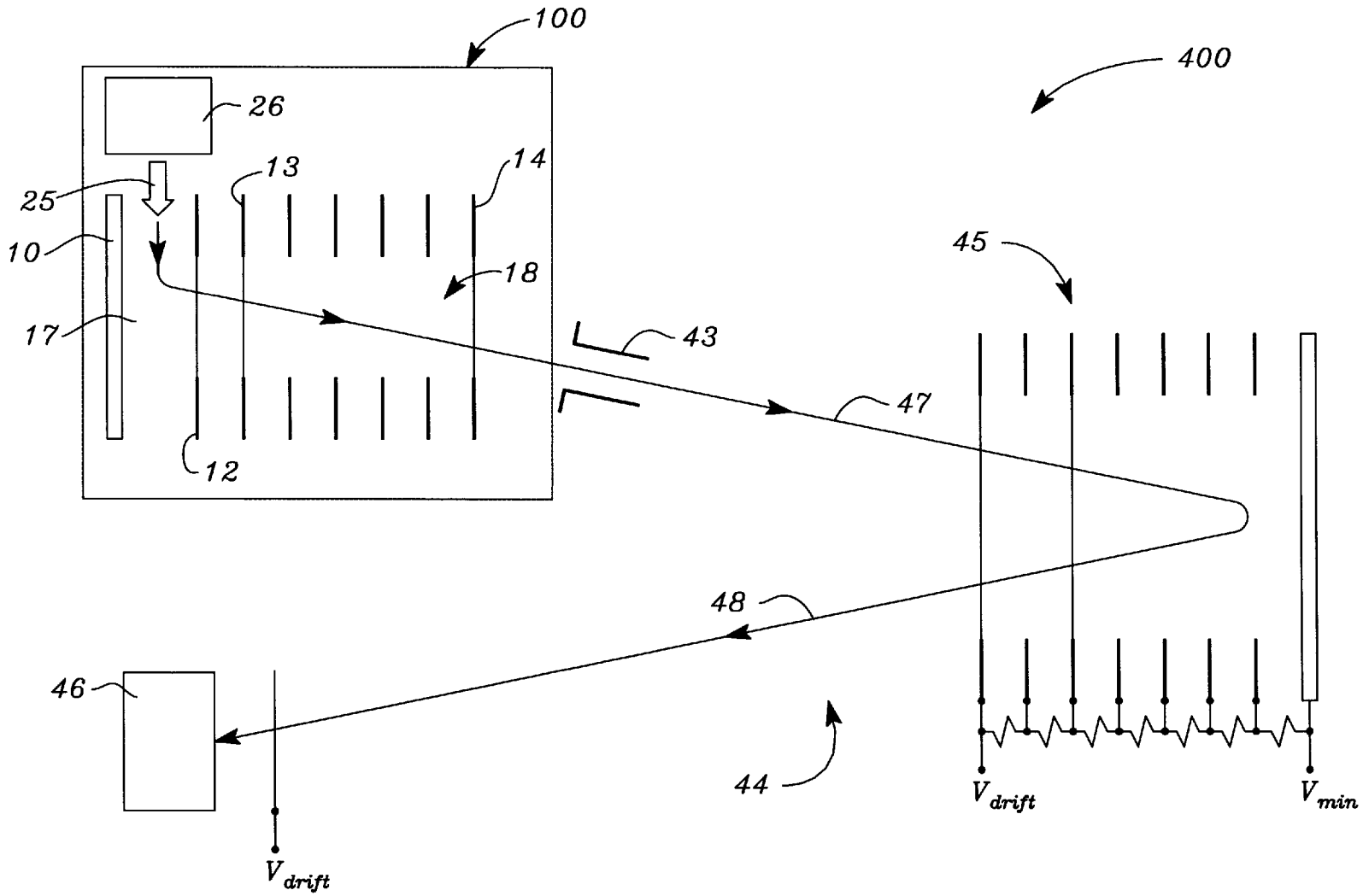
FIG. 9 illustrates a schematic diagram of a time-of-flight mass spectrometer including the ion acceleration apparatus in accordance with the present invention.

The ion acceleration apparatus 100 and method 200 are particularly useful in mass spectrometry. FIG. 9 illustrates a time-of-flight mass spectrometer TOFMS 400 in accordance with a preferred embodiment of the invention. The TOFMS 400 comprises the ion acceleration apparatus 100 of the invention described above. The TOFMS 400 further comprises an ion source 26, deflection plates 43, an ion drift region 44, a two-stage mirror 45, an ion detector 46, a guard grid, which advantageously can be conventional components. The TOFMS is housed in a vacuum chamber. The vacuum prevents interference of the motion of the ions resulting from the presence of an atmosphere.

The ion source 26 is positioned adjacent to the ion acceleration apparatus 100. During the fill period, low-energy analyte ions 25 generated by the ion source 26 enter the fill region 17 of the ion acceleration apparatus 100. The analyte ions 25 are delivered in a parallel beam and move into the fill region 17 in a direction essentially normal to an ion path through the acceleration region 18. During the pulse period, the analyte ions 25 are accelerated by the ion acceleration apparatus 100 and pushed out from the ion acceleration apparatus 100 into the drift region 44. The analyte ions 25 leaving the acceleration apparatus 100 are grouped in bunches or packets separated in time. A pair of deflection plates 43 is placed in the drift region 44 to correct the ion trajectory and align the path 47 of the analyte ions with an aperture of the two-stage mirror 45. The drift region 44 is maintained at a potential of about $V_{drift}$ volts. The analyte ions 25 packets enter the two-stage electrostatic mirror 45. The mirror 45 equalizes the time-of-flight of the analyte ions 25 of the same mass with different initial coordinates and energies and increases the differential separation between analyte ions 25 having different masses. Reflected analyte ions packets pass back through the drift region 44 to the ion detector 46 along path 48 where they are detected.

The TOFMS 400 of the invention provides greater sensitivity to the measurement capability of state-of-the-art TOFMS at a lower cost and with less complexity. The ion acceleration apparatus 100 of the present invention utilizes only pulse generator 34 to control ion flow during the fill and pulse periods as opposed to two pulse generators of the conventional ion accelerator known in the art. With only one high voltage pulse generator 34 the ion acceleration apparatus 100 and, therefore, the TOFMS 400 can be manufactured at a lower cost than with the conventional ion accelerator. In addition, the use of a single pulse generator 34 obviates the need and expense of synchronizing two pulse generators, and the reliability issues associated therewith, as is required in the conventional ion accelerator. Thus, the ion acceleration apparatus 100, method 200, and the TOFMS 400 of the present invention also have improved reliability at a lower cost. Further, the present invention retains the low ion leakage properties with fewer parts and at a lower cost compared to conventional ion accelerators.

Thus there has been described a novel ion acceleration apparatus and method and mass spectrometer, which are particularly useful in time-of-flight mass spectrometry. It should be understood that the above-described embodiments are merely illustrative of the some of the many specific embodiments that represent the principles of the present invention. Clearly, those skilled in the art can readily devise numerous other arrangements without departing from the scope of the present invention.

What is claimed is:

1. An apparatus for pulse modulating and accelerating analyte ions comprising:

a plurality of conductive plates in a stacked relationship, the plurality of plates comprising:

a solid pulser electrode at an input end of the stack; and a plurality of grids forming a fill region in a space disposed between the pulser electrode and a first grid of the plurality of grids, and an acceleration region adjacent to the fill region in a space disposed between a second grid and a third grid of the plurality of grids, wherein the fill region collects the analyte ions during a fill period and the acceleration region accelerates the collected analyte ions toward the third grid at an output end of the stack during a pulse period, the analyte ions having a charge polarity, wherein during the fill period, the purser electrode and the first grid each has a fill voltage with a polarity opposite to the charge polarity of the analyte ions to prevent leakage of the collected analyte ions from the fill region into the acceleration region before the pulse period, such that baseline noise is reduced, and during the pulse period, the pulser electrode and the first grid each has a pulse voltage with a polarity that is the same as the charge polarity of the analyte ions to launch the collected analyte ions out of the fill region and into the acceleration region, and wherein during both the fill period and the pulse period, the second grid has zero voltage and the third grid has a constant voltage with a polarity that is opposite the charge polarity of the analyte ions, at least the constant voltage on the third grid inducing the launched analyte ions to accelerate toward the third grid.

2. The apparatus of claim 1 wherein the fill voltage and the pulse voltage on the electrode are greater in magnitude than the fill voltage and the pulse voltage on the first grid.

3. The apparatus of claim 1, further comprising a power source that comprises:

a pulse generator that supplies each of the fill voltages during the fill period and each of the pulse voltages during the pulse period to the pulser electrode and to the first grid;

a voltage source that supplies the constant voltage to the third grid, the second grid being connected to ground; and a first voltage divider between the pulse generator and the first grid, such that the fill voltage and the pulse voltage provided to the first grid are lower magnitude replicas of the fill voltage and the pulse voltage provided to the pulser electrode.

4. The apparatus of claim 1, wherein the plurality of conductive plates further comprises a plurality of guard frames interposed between the second grid and the third grid, each guard frame of the plurality of guard frames having a constant voltage with a polarity opposite to the charge polarity of the analyte ions; and wherein the apparatus further comprises a power source that comprises:

a pulse generator that supplies each of the fill voltages during the fill period and each of the pulse voltages during the pulse period to the pulser electrode and to the first grid;

a voltage source that supplies each of the constant voltages to the third grid and the plurality of guard frames, the second grid being connected to ground;

a first voltage divider between the pulse generator and the first grid, such that the fill voltage and the pulse voltage supplied to the first grid are lower magnitude replicas of the fill voltage and the pulse voltage supplied to the pulser electrode; and a second voltage divider connected between the voltage source and each of the guard frames in the plurality of guard frames, such that the constant voltage applied to each guard frame by the voltage source increases in magnitude from a first guard frame adjacent to the second grid to a last guard frame adjacent to the third grid.

5. The apparatus of claim 1 used in a mass spectrometer, such that the reduced baseline noise increases signal to noise ratio and sensitivity of the mass spectrometer.

6. A mass spectrometer with increased signal to noise ratio and sensitivity comprising an ion source for providing analyte ions having a charge polarity, a drift region, an ion detector and an apparatus for pulse modulating and accelerating the analyte ions into the drift region for detection by the ion detector, the apparatus comprising:

a plurality of conductive plates in a stacked relationship, the plurality of plates comprising:

a solid pulser electrode at an input end of the stack; and a plurality of grids forming a fill region in a space disposed between the pulser electrode and a first grid of the plurality of grids, and an acceleration region adjacent to the fill region in a space disposed between a second grid and a third grid of the plurality of grids, wherein the fill region collects the analyte ions during a fill period and the acceleration region accelerates the collected analyte ions toward the third grid at an output end of the stack during a pulse period, the analyte ions having a charge polarity, wherein during the fill period, the pulser electrode and the first grid each has a fill voltage with a polarity opposite to the charge polarity of the analyte ions to prevent leakage of the analyte ions from the fill region into the acceleration region before the pulse period, such that baseline noise is reduced, and during the pulse period, the pulser electrode and the first grid each has a pulse voltage with a polarity that is the same as the charge polarity of the analyte ions to launch the collected analyte ions out of the fill region and into the acceleration region, and wherein during both the fill period and the pulse period, the second grid has zero voltage and the third grid has a constant voltage with a polarity that is opposite the charge polarity of the analyte ions, at least the constant voltage on the third grid inducing the launched analyte ions to accelerate toward the third grid.

7. The mass spectrometer of claim 6, wherein the apparatus further comprises:

a pulse generator for supplying the fill voltage and the pulse voltage to the electrode and to the first grid;

a first voltage divider between the pulse generator and the first grid, such that the fill voltage and the pulse voltage provided to the first grid are lower magnitude replicas of the fill voltage and the pulse voltage provided to the electrode; and a voltage source for supplying the constant voltage to the third grid, wherein the second grid is connected to ground.

8. A method of pulse modulating and accelerating analyte ions having a charge polarity in an ion accelerator that comprises a plurality of conductive plates in a stacked relationship, the method comprising the steps of:

during a fill period, simultaneously applying a ill voltage to a pulser electrode and a fill voltage to a first grid spaced from and adjacent to the electrode, wherein the magnitude of the first grid fill voltage is less than or equal to the magnitude of the pulser electrode fill voltage, such that the analyte ions are collected in a fill region in the space between the pulser electrode and the first grid, and wherein the fill voltages have an opposite charge polarity to the charge polarity of the analyte ions to prevent leakage of the collected analyte ions from the fill region into the acceleration region before a pulse period, such that baseline noise is reduced;

during a pulse period, simultaneously applying a pulse voltage to the pulser electrode and a pulse voltage to the first grid, wherein the magnitude of the first grid pulse voltage is less than or equal to the magnitude of the pulser electrode pulse voltage, and wherein the pulse voltages have a same charge polarity as the charge polarity of the collected analyte ions, such that the analyte ions are induced to move out of the fill region and into an acceleration region between a second grid and a third grid, the second grid being spaced apart from and adjacent to the first grid and the third grid being at an output end of the ion accelerator; and during both the fill period and the pulse period, simultaneously applying a constant bias voltage to the third grid such that the analyte ions are accelerated in the acceleration region toward the third grid, the second grid being at a ground potential of zero volts.

9. The method of claim 8, wherein the first grid fill and pulse voltages are fractions of the pulser electrode fill and pulse voltages, respectively.

* * * * *